US006646365B1

(12) United States Patent
Denissen et al.

(10) Patent No.: US 6,646,365 B1
(45) Date of Patent: Nov. 11, 2003

(54) LOW-PRESSURE MERCURY-VAPOR DISCHARGE LAMP

(75) Inventors: Cornelis Johannes Maria Denissen, Nuth (NL); Cornelis Reinder Ronda, Aachen (DE); Volker Ulrich Weiler, Aachen (DE); Klaus Gawron, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 393 days.

(21) Appl. No.: 09/716,910

(22) Filed: Nov. 20, 2000

(30) Foreign Application Priority Data

Nov. 24, 1999 (EP) ..... 99203937

(51) Int. Cl.[7] ..... H01J 1/00

(52) U.S. Cl. ..... 313/238; 313/492; 313/613; 313/352

(58) Field of Search ..... 313/238, 492, 313/613, 616, 609, 493, 239, 352

(56) References Cited

U.S. PATENT DOCUMENTS

| | | | | | |
|---|---|---|---|---|---|
| 2,946,909 | A | * | 7/1960 | Morehead | 313/43 |
| 3,898,511 | A | * | 8/1975 | Johnson et al. | 313/490 |
| 5,686,795 | A | * | 11/1997 | Sakoske et al. | 313/613 |
| 6,359,385 | B1 | * | 3/2002 | Denissen et al. | 313/613 |
| 6,445,121 | B1 | * | 9/2002 | Roes et al. | 313/492 |

FOREIGN PATENT DOCUMENTS

DE 1060991 2/1957

* cited by examiner

*Primary Examiner*—Robert H. Kim
*Assistant Examiner*—Jurie Yun

(57) ABSTRACT

A low-pressure mercury-vapor discharge lamp has a discharge vessel with a filling of mercury and an inert gas. Electrodes in the discharge space have electrode shields, which operate at temperatures above 450° C. An inner surface of the electrode shield may have a heat-absorbing coating, for example a carbon film. The electrode shield may be supported by a support wire, at least a part of which is made from stainless steel. A lamp according to the invention has comparatively low mercury consumption.

4 Claims, 4 Drawing Sheets

LOW-PRESSURE MERCURY-VAPOR DISCHARGE LAMP

The invention relates to a low-pressure mercury-vapor discharge lamp comprising a discharge vessel, which discharge vessel encloses a discharge space containing a filling of mercury and an inert gas in a gastight manner, electrodes being arranged in the discharge space for generating and maintaining a discharge in said discharge space, and an electrode shield at least substantially surrounding at least one of the electrodes.

In mercury-vapor discharge lamps, mercury is the primary component for (efficiently) generating ultraviolet (UV) light. An inner surface of the discharge vessel may be provided with a luminescent layer containing a luminescent material (for example a fluorescent powder) for converting UV to other wavelengths, for example to UV-B and UV-A for tanning purposes (sunbed lamps) or to visible radiation. Such discharge lamps are therefore also referred to as fluorescent lamps.

A low-pressure mercury-vapor discharge lamp of the type mentioned in the opening paragraph is known from DE-A 1 060 991. In said known lamp, the electrode shield surrounding the electrode is made from thin sheet titanium. By using an electrode shield, which is also referred to as anode shield or cathode shield, blackening at an inner surface of the discharge vessel is counteracted. In this respect, titanium serves as the getter for chemically binding oxygen, nitrogen and/or carbon.

A drawback of the use of such an electrode shield is that the titanium in the electrode shield may amalgamate with the mercury present in the lamp and, thus, absorb mercury. As a result, the known lamp requires a relatively high dose of mercury to obtain a sufficiently long service life. Injudicious processing of the known lamp after its service life has ended adversely affects the environment.

It is an object of the invention to provide a low-pressure mercury-vapor discharge lamp of the type mentioned in the opening paragraph, which has a relatively low mercury consumption.

To achieve this, the low-pressure mercury-vapor discharge lamp in accordance with the invention is characterized in that, during nominal operation, the temperature of the electrode shield is above 450° C.

In the description and the claims of the current invention, the designation "nominal operation" is used to indicate operating conditions where the mercury vapor pressure is such that the radiant efficacy of the lamp is at least 80% of that during optimum operation, i.e. operating conditions where the mercury vapor pressure is optimal.

For the proper operation of low-pressure mercury-vapor discharge lamps, the electrodes of such discharge lamps include an (emitter) material having a low so-called work function (reduction of the work function voltage) for supplying electrons to the discharge (cathode function) and receiving electrons from the discharge (anode function). Known materials having a low work function are, for example, barium (Ba), strontium (Sr) and calcium (Ca). It has been observed that, during operation of low-pressure mercury-vapor discharge lamps, material (barium and strontium) of the electrode(s) is subject to evaporation. It has been found that, in general, the emitter material is deposited on the inner surface of the discharge vessel. It has further been found that Ba (and Sr) which is deposited elsewhere in the discharge vessel, no longer participates in the electron emission process. The deposited (emitter) material further forms mercury-containing amalgams on the inner surface, as a result of which the quantity of mercury available for the discharge decreases (gradually), which may adversely affect the service life of the lamp. In order to compensate for such a loss of mercury during the service life of the lamp, a relatively high dose of mercury in the lamp is necessary, which is undesirable from the point of view of environmental protection.

The provision of an electrode shield, which surrounds the electrode(s) and, during nominal operation, is at a temperature above 250° C., causes the reactivity of materials in the electrode shield relative to the mercury present in the discharge vessel, leading to the formation of amalgams (Hg—Ba, Hg—Sr), to be reduced.

It has further been found in experiments that emitter material which evaporates from the electrode reacts with the material of the electrode shield, thereby forming oxides (BaO or SrO). During (nominal) operation of the discharge lamp, mercury makes a bond with these oxides of evaporated emitter material. If reactive oxygen is present in the proximity of the electrode, then BaO, SrO and/or HgO and, possibly, $SrHgO_2$ and $BaHgO_2$ are formed. If, in addition, tungsten (originating from the electrode) is deposited (in the case of a cold start, tungsten is sputtered) also $WO_X$ and $HgWO_X$ are formed. Without being obliged to give any theoretical explanation, it seems that although BaO and SrO do not react with mercury under normal thermal conditions, the presence of the discharge in the discharge space plays a part in the formation of these compounds of mercury and the oxides of evaporated emitter material. At temperatures above 450° C. the mercury is released again, as a result of dissociation of said compounds of mercury and the oxides of evaporated emitter material, and the released mercury is available again for the discharge. Particularly HgO dissociates at a temperature of 450° C. or higher; the compounds $SrHgO_2$ and $BaHgO_2$ are slightly more stable. The inventors have recognized that by using an electrode shield having a temperature of 450° C. or higher, mercury is released from the compounds of mercury and oxides of emitter material. A particularly suitable temperature of the electrode shield is approximately 500° C., at which temperature also the dissociation of, in particular, $SrHgO_2$ and $BaHgO_2$ takes place relatively rapidly. It cannot be excluded, however, that the stainless steel also acts as a getter (corrosion) at the above-mentioned relatively high temperatures, leading to an additional reduction of the formation of HgO-type compounds.

The known lamp comprises an electrode shield of thin sheet titanium, which material relatively readily amalgamates with mercury. The mercury consumption of the discharge lamp is limited by substantially reducing the degree to which the material of the electrode shield, which surrounds the electrode(s), reacts with mercury and/or bonds with mercury.

In addition, the use of an electrically insulating material precludes the development of short circuits in the electrode wires and/or in a number of windings of the electrode(s). The known lamp has an electrode shield of an electroconductive material, which, in addition, relatively readily forms an amalgam with mercury. The mercury consumption of the discharge lamp is limited by substantially reducing the degree to which the material of the shield surrounding the electrode(s) reacts with mercury.

In order to obtain an electrode shield which can be heated to such high temperatures during nominal operation of the discharge lamp and, during operation, is capable of maintaining said high temperatures throughout the service life of the discharge lamp, the electrode shield is preferably manufactured from a metal or a metal alloy which can withstand temperatures of 450° C. or higher. An "electrode shield which can withstand high temperatures" is to be taken to mean in the description of the current invention, that, during the service life of the discharge lamp and at said temperatures, the material from which the electrode shield is manufactured does not show signs of degassing and/or evaporation, which adversely affect the operation of the discharge lamp, and that no appreciable changes in shape occur in the electrode shield at such high temperatures.

A preferred embodiment of the low-pressure mercury-vapor discharge lamp is characterized in accordance with the invention in that the electrode shield is made from stainless steel. Stainless steel is a material which is resistant to high temperatures. Stainless steel has a high corrosion resistance, a relatively low coefficient of thermal conduction and a relatively poor thermal emissivity as compared to the known materials. By virtue thereof it becomes possible to manufacture a stainless steel electrode shield which can relatively readily reach temperatures above 450° C. by exposure to heat originating from the electrode. Materials which can very suitably be used to manufacture the electrode shield are chromium-nickel-steel and Duratherm 600.

In a particularly favorable embodiment of the low-pressure mercury-vapor discharge lamp in accordance with the invention, the electrode shield is provided, at a side facing away from the electrode, with a low-emissivity coating for reducing the radiation losses of the electrode shield. By applying such a layer to an outer surface of the electrode shield, the desired relatively high temperatures of the electrode shield can be reached more readily. The low-emissivity coating preferably comprises chromium or a noble metal, for example gold. Other materials which can suitably be used for a low-emissivity coating on the outer surface of the electrode shield are titanium nitride, chromium carbide, aluminum nitride and silicon carbide. In an alternative embodiment of the low-pressure mercury-vapor discharge lamp, the electrode shield is polished on a side facing the discharge. Also a polishing treatment of the outer surface of the electrode shield causes the heat radiation by the electrode shield to be reduced.

A further preferred embodiment of the low-pressure mercury-vapor discharge lamp in accordance with the invention is characterized in that the electrode shield is provided, at a side facing the electrode, with an absorbing coating for absorbing radiation. By applying a layer having a relatively high emissivity in the infrared radiation range, the heat-absorbing capacity of the electrode shield is increased. By virtue thereof, the desired relatively high temperatures of the electrode shield can be reached more readily. The absorbing coating preferably comprises carbon.

The shape of the electrode shield, its position relative to the electrode and the way in which the electrode shield is provided influence the temperature of the electrode shield. Electrodes in low-pressure mercury-vapor discharge lamp are generally elongated and cylindrically symmetric, for example a coil with windings about a longitudinal axis. A tubularly shaped electrode shield harmonizes very well with such a shape of the electrode. Preferably, an axis of symmetry of the electrode shield extends substantially parallel to, or substantially coincides with, the longitudinal axis of the electrode. In the latter case, the average distance from an inside of the electrode shield to an external dimension of the electrode is at least substantially constant.

Preferably, the electrode shield is provided with a slit on a side facing the discharge space. A slit in the electrode shield in the direction of the discharge causes a relatively short discharge path between the electrodes of the low-pressure mercury-vapor discharge lamp. This is favorable for a high efficiency of the lamp. The slit preferably extends parallel to the axis of symmetry of the electrode shield (so-called lateral slit in the electrode shield). In the known lamp, the aperture or slit in the electrode shield faces away from the discharge space.

The electrode shield is generally held in the desired position around the electrode by means of a support wire, which support wire can be mounted in the discharge vessel in various ways. A further preferred embodiment of the low-pressure mercury-vapor discharge lamp in accordance with the invention is characterized in that a support wire carries the electrode shield, and at least a part of said support wire is made from stainless steel. Stainless steel has a relatively low coefficient of thermal conduction, thereby reducing the emission of heat from the electrode shield to the support wire.

These and other aspects of the invention will be apparent from and elucidated with reference to the embodiments described hereinafter.

Figure 4:
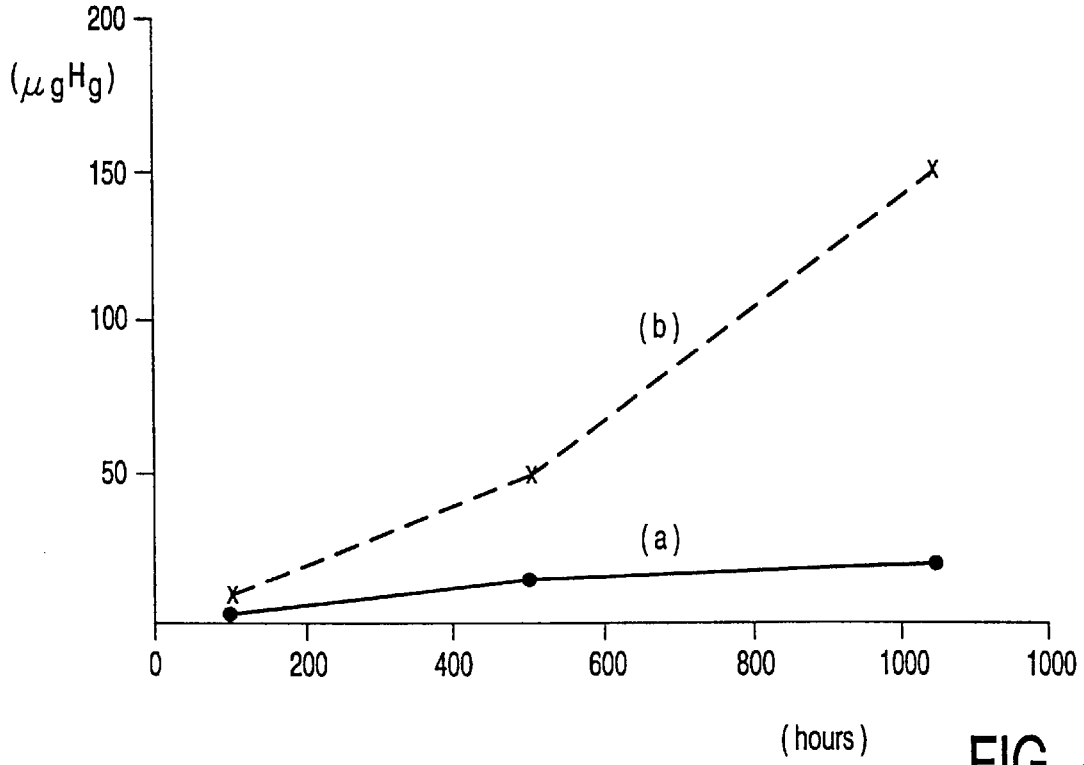
Figure 5:
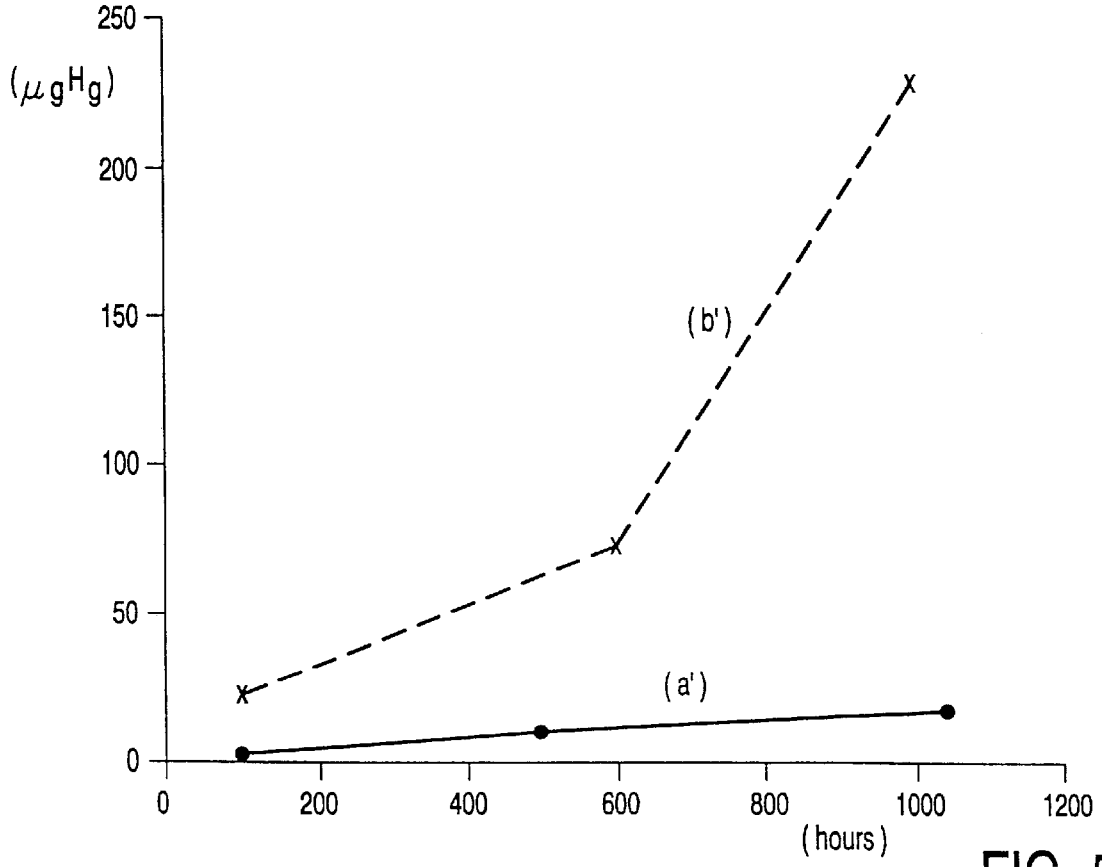

FIG. 4 shows the mercury consumption of a low-pressure mercury-vapor discharge lamp with an electrode shield in accordance with the invention, operated on a cold-start ballast with a short cycle, in comparison with the mercury consumption of the known discharge lamp, and FIG. 5 shows the mercury consumption of a low-pressure mercury-vapor discharge lamp with an electrode shield in accordance with the invention, operated on a dimmed ballast with a long cycle, in comparison with the mercury consumption of the known discharge lamp.

The Figures are purely schematic and not drawn to scale. Particularly for clarity, some dimensions are exaggerated strongly. In the Figures, like reference numerals refer to like parts whenever possible.

Figure 1:
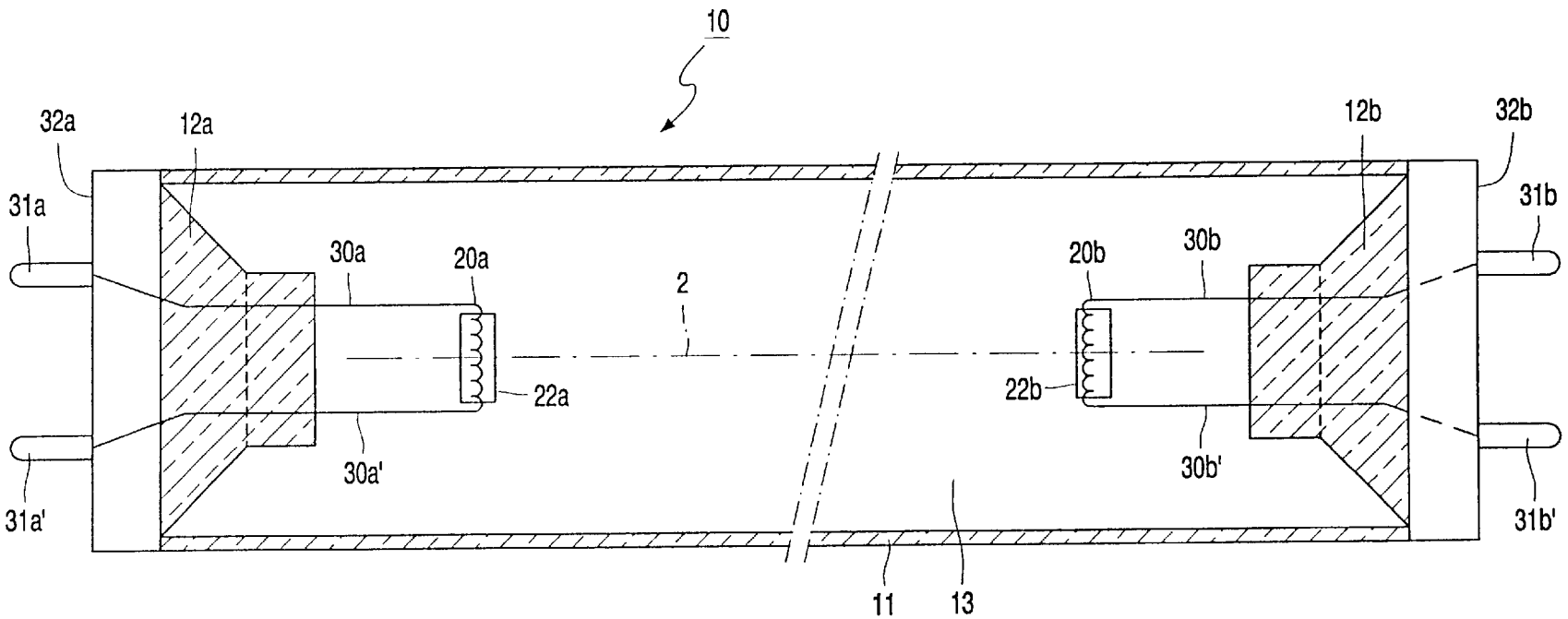
FIG. 1 is a cross-sectional view of an embodiment of the low-pressure mercury-vapor discharge lamp in accordance with the invention in longitudinal section.

FIG. 1 shows a low-pressure mercury-vapor discharge lamp comprising a glass discharge vessel 10 having a tubular portion 11 about a longitudinal axis 2, which discharge vessel transmits radiation generated in the discharge vessel 10 and is provided with a first and a second end portion 12*a*; 12*b*, respectively. In this example, the tubular part 11 has a length of 120 cm and an inside diameter of 24 mm. The discharge vessel 10 encloses, in a gastight manner, a discharge space 13 containing a filling of less than 3 mg mercury and an inert gas, for example argon. The wall of the tubular part is generally coated with a luminescent layer (not shown in FIG. 1) which includes a luminescent material (for example a fluorescent powder) which converts the ultraviolet (UV) light generated by fallback of the excited mercury into (generally) visible light. The end portions 12*a*; 12*b* each support an electrode 20*a*; 20*b* arranged in the discharge space 13. The electrode 20*a*; 20*b* is a winding of tungsten covered with an electron-emitting substance, in this case a mixture of barium oxide, calcium oxide and strontium oxide.

Current-supply conductors 30*a*, 30*a*'; 30*b*, 30*b*' of the electrodes 20*a*; 20*b*, respectively, pass through the end portions 12*a*; 12*b* and issue from the discharge vessel 10 to the exterior. The current-supply conductors 30*a*, 30*a*'; 30*b*, 30*b*' are connected to contact pins 31*a*, 31*a*'; 31*b*, 31*b*' which are secured to a lamp cap 32*a*, 32*b*. In general, around each electrode 20*a*; 20*b* an electrode ring is arranged (not shown in FIG. 1) on which a glass capsule for proportioning mercury is clamped. In an alternative embodiment, an amalgam comprising mercury and an alloy of PbBiSn is provided in an exhaust tube (not shown in FIG. 1) which is in communication with the discharge vessel 10.

In the example shown in FIG. 1, the electrode 20*a*; 20*b* is surrounded by an electrode shield 22*a*; 22*b* whose temperature, in accordance with the invention, is above 450 ° C. during nominal operation. At said temperatures, dissociation causes mercury bonded to BaO or SrO on the electrode shield 22*a*; 22*b* to be released again, so that it is available for the discharge in the discharge space. A particularly suitable temperature of the electrode shield is approximately 500° C. In the example shown in FIG. 1, the electrode shield 22*a* is made from stainless steel. At said high temperatures, such an electrode shield is dimensionally stable, corrosion resistant and exhibits a relatively low heat emissivity. A material which can suitably be used to manufacture the electrode shield is chromium-nickel-steel (AlSi 316) having the following composition (in % by weight): at most 0.08% C, at most 2% Mn, at most 0.0045% P, at most 0.030% S, at most 1% Si, 16–18% Cr, 10–14% Ni, 2–3% Mo and the rest Fe. It has been observed that the outside surface of such an electrode shield becomes slightly darker in color during the manufacture of the discharge lamp. Another material which is particularly suitable for the manufacture of the electrode shield is Duratherm 600, which is a CoNiCrMo alloy having an increased corrosion resistance, the composition of which is as follows: 41.5% Co, 12% Cr, 4% Mo, 8.7% Fe, 3.9% W, 2% Ti, 0.7% Al and the rest Ni.

Figure 2:
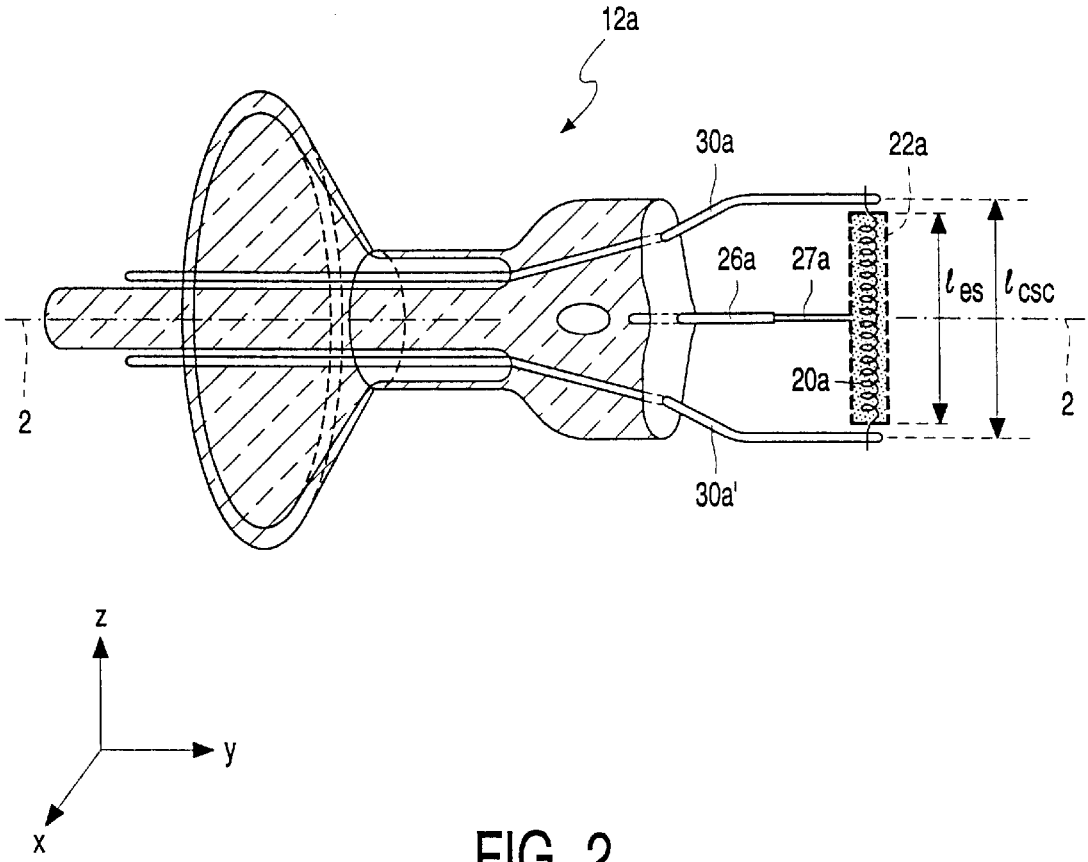
FIG. 2 shows a detail of FIG. 1, which is partly drawn in perspective.

FIG. 2 is a partly perspective view of a detail shown in FIG. 1, the end portion 12*a* supporting the electrode 20*a* via the current supply conductors 30*a*, 30*a*'. For orientation purposes, the drawing of FIG. 2 is provided with a Cartesian system of coordinates. The distance between the current supply conductors 30*a*, 30*a*' at the location where these conductors support the electrode 22*a* is designated $l_{csc}$. The electrode 20*a* is surrounded by a tubular (cylindrically symmetric) electrode shield 22*a* having a length $l_{es}$. Experiments have shown that, in an electrode shield in accordance with the invention, a suitable ratio of the length $l_{es}$, of the electrode shield to the distance $l_{csc}$ between the current supply conductors meets the relation:

$$0.55 \leqq l_{es}/l_{csc} \leqq 0.80.$$

Preferably:

$$0.6 \leqq l_{es}/l_{csc} \leqq 0.65.$$

For example, if $l_{csc}$=8 mm, a very suitable length of the electrode shield would be $l_{es}$=6 mm.

In FIG. 2, the electrode shield is supported by a support wire 26*a*, 27*a*, which, in this example, is provided in the end portion 12*a*. In an alternative embodiment, the support wire 26*a*, 27*a* is connected with one of the current supply conductors 30*a*, 30*a*'. In the example shown in FIG. 2, the support wire 26*a*, 27*a* is composed of a section 26*a* of iron, having a thickness of approximately 0.9 mm, and a section 27*a* is manufactured, in accordance with the invention, from stainless steel. The section 27*a* of the support wire 26*a*, 27*a* is connected by means of welded joints to, on the one hand, the electrode shield 22*a* and, on the other hand, to the further section 26*a* of the support wire 26*a*, 27*a*. Stainless steel has a very low coefficient of thermal conduction with respect to the known materials (for example iron) used as a support wire. The electrode shield 22*a* is capable of maintaining its comparatively high temperature because the section 27*a* of the support wire 26*a*, 27*a* effectively reduces the dissipation of heat from the electrode shield 22*a*. Preferably, the section 27*a* of the support wire 26*a*, 27*a* is made from stainless steel in a thickness which meets the relation:

$$0.2 \leqq d_{sw} \leqq 0.5 \text{ mm}.$$

A stainless steel section 27*a* of the support wire having a thickness of 0.4 mm is particularly suitable. Such a wire thickness is sufficiently thick ($d_{sw} \geqq 0.2$ mm) to ensure that the electrode shield 22*a* is properly supported and, on the other hand, sufficiently thin ($d_{sw} \leqq 0.5$ mm) to reduce heat dissipation via this section 27*a* of the support wire. In a further alternative embodiment, the electrode shield is directly provided on the current supply conductors, for example, in that the electrode shield is provided with contracted portions which are a press fit on the current supply conductors.

Preferably, the electrode shield 22*a* is provided with a lateral slit (not shown in FIG. 2) on the side of the discharge lamp facing the discharge space. In an alternative embodiment, the slit in the electrode shield is provided on the side of the electrode shield facing away from the discharge space. The electrode shield does not necessarily have to be tubular in shape, it may alternatively be angular, for example triangular, quadrangular or polygonal.

Figure 3A:
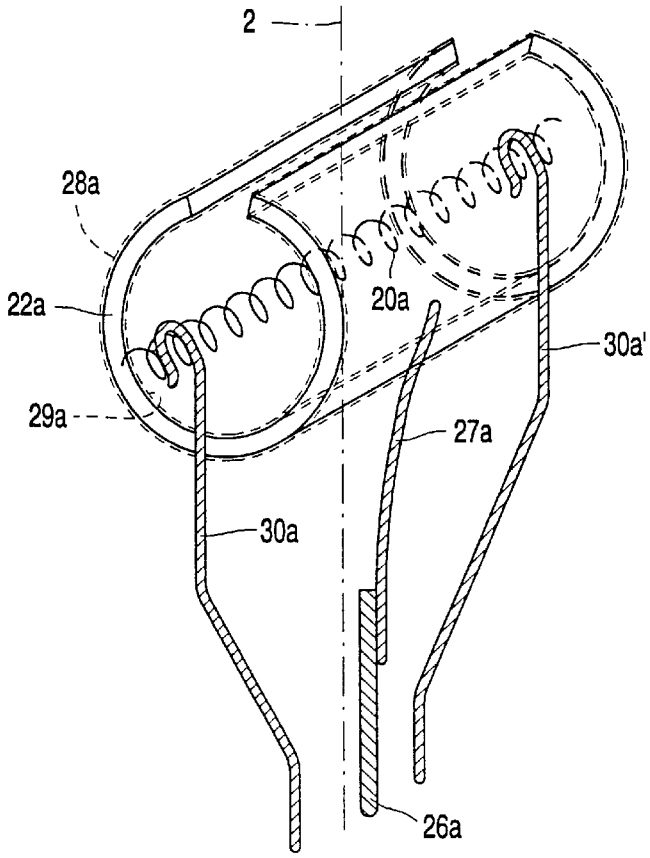
FIG. 3A is a perspective view of an embodiment of the electrode shield surrounding the electrode as shown in FIG. 2.

FIG. 3A is a perspective view of an embodiment of the tubular electrode shield 22*a* around the electrode 20*a*, as shown in FIG. 2. In FIG. 3A, the electrode 20*a* is represented so as to be spiral-shaped. In order to enable temperatures of the electrode shield 22*a* above 450° C. to be achieved during operation, preferably approximately 500° C., an outside surface of the electrode shield 22*a* is provided with a low-emissivity coating 28*a* to reduce the radiation losses of the electrode shield 22*a*. Said low-emissivity coating 28*a* preferably comprises a chromium film. In an alternative embodiment, the low-emissivity coating 28*a* comprises a noble metal, for example a gold film. The electrode shield 22*a* shown in FIG. 3A is further provided with an absorbing coating 29*a* at an inner surface, which absorbing coating serves to absorb (heat) radiation. The absorbing coating 29*a* preferably comprises carbon.

Figure 3B:
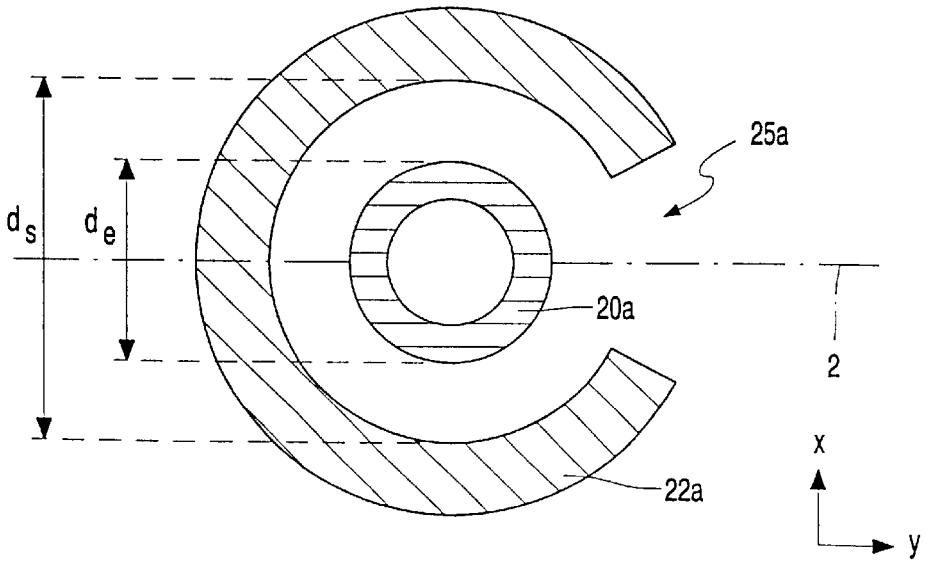
FIG. 3B is a cross-sectional view of an embodiment of the electrode shield surrounding the electrode as shown in FIG. 2.

FIG. 3B is a cross-sectional view of an embodiment of the tubular electrode shield 22*a* around the electrode 20, as shown in FIG. 2. The orientation corresponds to the system of coordinates shown in FIG. 2. In FIG. 3B, the electrode 20*a* is very diagrammatically represented as a part of one turn, the outer circumference of the electrode 20*a* being designated $d_e$. The cylindrically symmetric electrode shield 20*a* has an inside circumference which is designated $d_s$. On the side of the discharge lamp facing the discharge, the electrode shield 22*a* is provided with a lateral slit 25*a*. In a particularly preferred embodiment, the electrode 20*a* has an outside diameter $d_e$=2 mm, the electrode shield has a length $l_s$=6 mm and an inside diameter $d_s$=3.6 mm. A favorable wall thickness of the stainless steel electrode shield 22*a* is 0.2 mm. An outside diameter of the stainless steel electrode shield 22*a* is 4 mm. Given the diameter of the electrode 20*a*, $d_s=1.5\times d_e$ and the electrode shield 22*a* meets the relation:

$$1.25\times d_e \leqq d_s \leqq 2.5\times d_e.$$

During nominal operation of the discharge lamp, the temperature of a tubular electrode shield having a length of 8 mm and a diameter of 6 mm, which is made from iron and is secured to the end portion of the discharge lamp by means of a standard support wire of iron (thickness 0.9 mm), is approximately 230° C. If the same electrode shield is mounted on a stainless steel support wire (thickness 0.4 mm), then the temperature of said electrode shield under otherwise equal conditions is approximately 270° C.

A ceramic electrode shield having a length of 6mm and a diameter of 4 mm, which is mounted on a standard iron support wire has, under otherwise equal conditions, a temperature of 350° C.

A stainless steel electrode shield having a wall thickness of 0.2 mm, a length of 6 mm and a diameter of 4 mm, which is mounted on a standard iron support wire, has a temperature of approximately 430° C. during nominal operation of the discharge lamp. If the same electrode shield is mounted on a stainless steel support wire (thickness 0.4 mm), then the temperature of said electrode shield under otherwise equal conditions is approximately 470° C.

A stainless steel electrode shield having a wall thickness of 0.2 mm, a length of 6 mm and a diameter of 4 mm, an outer surface of which is coated with a chromium film (low-emissivity coating) and which is mounted on a stainless steel support wire (thickness 0.4 mm), has a temperature of approximately 510° C. during nominal operation of the discharge lamp. The same electrode shield, which is additionally provided with a carbon layer (heat-absorbing coating) on an inner surface, has under otherwise equal conditions a temperature of 540° C.

(Life) tests have shown that a low-pressure mercury-vapor discharge lamp provided with a tubular electrode shield made of stainless steel and provided around the electrode exhibits a mercury consumption in the area of the electrode of less than 1 $\mu$g after 100 burning hours on a so-called high-frequency regulating (HFR) dimming ballast, whereas a reference lamp provided with the known electrode shield exhibits a mercury consumption in the area of the electrode of more than 20 $\mu$g. After 10,000 burning hours, the reference lamps operated on such a ballast can no longer be started for lack of mercury. Such a service life is substantially shorter than the customary service life of these discharge lamps, which amounts to approximately 17,000 hours.

In further experiments, low-pressure mercury-vapor discharge lamps manufactured in accordance with the invention were compared to known discharge lamps. In FIG. 4, the mercury consumption of a low-pressure mercury-vapor discharge lamp comprising an electrode shield in accordance with the invention is compared with the mercury consumption of a known discharge lamp, the discharge lamps being operated on a so-called cold-start ballast with a short switching cycle in which the lamp, alternately, burns for 15 minutes and is switched off for 5 minutes. After 1100 hours, the electrode provided with a stainless steel electrode shield exhibited a mercury consumption in the area of the electrode of 15 $\mu$g (curve a), whereas the known lamp exhibited a mercury consumption in the area of the electrode of 148 $\mu$g (curve b). The use of the electrode shield in accordance with the invention causes the mercury consumption in the area of the electrode to be reduced by approximately 90%. In FIG. 5, the mercury consumption of a low-pressure mercury-vapor discharge lamp comprising an electrode shield in accordance with the invention is compared with the mercury consumption of a known discharge lamp, the discharge lamps being operated on a dimmed ballast for 1250 hours with a long switching cycle in which the lamps alternately burn for 165 minutes and are switched off for 15 minutes. After 1250 hours, the electrode comprising a stainless steel electrode shield exhibited a mercury consumption in the area of the electrode of 15 $\mu$g (curve a'), whereas the known lamp exhibited a mercury consumption in the area of the electrode of 225 $\mu$g (curve b'). This comparison shows that the known discharge lamp has a much higher mercury consumption during its service life than the discharge lamp provided with an electrode shield in accordance with the invention.

It will be obvious that within the scope of the invention many variations are possible to those skilled in the art. The discharge vessel does not necessarily have to be elongated and tubular; it may alternatively take different shapes. In particular, the discharge vessel may have a curved shape, for example like a meander or like a bend as used in a so-called compact fluorescent lamp.

The scope of protection of the invention is not limited to the above examples. The invention is embodied in each novel characteristic and each combination of characteristics. Reference numerals in the claims do not limit the scope of protection thereof. The use of the term "comprising" does not exclude the presence of elements other than those mentioned in the claims. The use of the term "a" or "an" in front of an element does not exclude the presence of a plurality of such elements.

What is claimed is:

1. A low-pressure mercury-vapor discharge lamp comprising a discharge vessel, the discharge vessel enclosing a discharge space containing a filling of mercury and an inert gas in a gastight manner, electrodes being arranged in the discharge space for generating and maintaining a discharge in said discharge space, and an electrode shield at least substantially surrounding at least one of the electrodes, wherein, during nominal operation, the temperature of the electrode shield is above 450° C., and the electrode shield is provided, at a side facing the electrode with an absorbing coating for absorbing radiation.

2. A low-pressure mercury-vapor discharge lamp comprising a discharge vessel, the discharge vessel enclosing, in a gastight manner, a discharge space containing a filling of mercury and an inert gas, electrodes being arranged in the discharge space for generating and maintaining a discharge in said discharge space, and an electrode shield at least substantially surrounding at least one of the electrodes, wherein, during nominal operation, the temperature of the electrode shield (22*a*) is above 450° C., and supports the electrode shield and at least a section of the support wire is made from stainless steel, said section being connected with the electrode shield.

3. A low-pressure mercury-vapor discharge lamp as claimed in claim 1, wherein that the absorbing coating comprises carbon.

4. A low-pressure mercury-vapor discharge lamp as claimed in claim 2, wherein the section of the support wire which is made from stainless steel has a thickness $d_{sw}$ in the range from $0.2 \leqq d_{sw} \leqq 0.5$ mm.

* * * * *